United States Patent [19]

Newsom

[11] Patent Number: 5,060,385

[45] Date of Patent: Oct. 29, 1991

[54] HAND-HELD RAZOR EDGE TRIMMER FOR FRAMES AND THE LIKE

[76] Inventor: Harold Newsom, 2023 Franklin St., Columbus, Ind. 47201

[21] Appl. No.: 661,200

[22] Filed: Feb. 27, 1991

[51] Int. Cl.[5] ..... B26B 29/00

[52] U.S. Cl. ..... 30/287; 30/294

[58] Field of Search ..... 30/294, 287, 293, 317, 30/320, 2

[56] References Cited

U.S. PATENT DOCUMENTS

| | | | |
|---|---|---|---|
| 1,908,851 | 5/1933 | Lafever et al. . | |
| 3,530,579 | 9/1970 | Dahlke | 30/293 X |
| 3,724,071 | 4/1973 | Hurtubise | 30/294 X |
| 4,495,697 | 1/1985 | Ruff | 30/294 |
| 4,667,409 | 5/1987 | D'Amato . | |

*Primary Examiner*—Douglas D. Watts

*Attorney, Agent, or Firm*—Sixbey, Friedman, Leedom & Ferguson

[57] ABSTRACT

A hand-held razor trimmer has a stepped razor blade mounting and guiding step formed on a palm-sized onto the top of this step and the side of the step runs on top of a frame edge. The body has a rear edge that is contoured to fit comfortably against the palm of the user's right or left hand, and forward edge portion that has a smooth top face for riding along a side of the frame edge, and a rear side that is contoured at its lateral edges to provide a safe and comfortable rest for the index finger of the user.

7 Claims, 2 Drawing Sheets

HAND-HELD RAZOR EDGE TRIMMER FOR FRAMES AND THE LIKE

BACKGROUND OF THE INVENTION

1. Field of the Invention

The present invention relates generally to hand-held trimming knives of the type which utilize a disposable razor blade for its cutting edge. More specifically, the invention relates to such a trimming knife which is specifically adapted for riding along the edge of the picture frame for trimming a paper dust cover applied over its rear surface.

2. Description of Related Art

Lafever et al. U.S. Pat. No. 1,908,851 shows a safety razor carton opener having a base plate having a step at one edge so as to form a flange on one side of the base. Bars project upwardly from the base for enabling the slot of a safety razor blade mounted over the bars so that they will be carried on the base at an acute angle to the step. A cover plate is applied onto the blade and bars and is held in place by a screw and wingnut assembly. While intended to be held in the hand of the user, the configuration of this trimmer is not designed to facilitate such use since its essentially block-like shape cannot be easily or comfortably held in a user's hand. Additionally, this trimmer is limited to use with appropriately slotted razor blades and the acute angle orientation of the single blade precludes the device from being used to trim in either direction of movement, up and back, or from being used in either hand without repositioning the blade from one set of bars to the other.

Also, a wallpaper trimmer is disclosed in U.S. Pat. No. 4,667,409 to D'Amato which consists of two blocks secured together by two screws to create a step at one edge and having a pair of angled cutting blades clamped between them. Like the trimmer of Lafever, this trimmer is intended to be held in the hand of the user, but the essentially block-like shape of the trimmer prevents it from being easily or comfortably held in a user's hand. While the oppositely acute angled pair of blades may be intended to allow ambidextrous use of the cutter in an up and back cutting motion with wall paper, if used to trim thin paper as used for the dust cover backing on picture frames, the point of the one of the blades which is facing away from the direction of motion can puncture and rip the paper.

Thus, there is still a need for a hand-held razor trimming device which can be comfortable held in either hand, and can cut in either direction of an up-and-back motion without fear of ripping even thin papers.

SUMMARY OF THE PRESENT INVENTION

The present invention has a primary object of providing a hand-held razor edge trimmer for frames and the like that can comfortably be held in either the right or left hand of a user to safely and easily trim material, such as dust cover paper, applied over the rear surface of the frame.

It is a further object to provide a trimmer which not only achieves the foregoing object, but is capable of being inexpensively manufactured.

In accordance with a preferred embodiment of the invention, the trimmer has a stepped razor blade mounting and guiding step formed on a palm-sized body of the trimmer. A pair of razor blades are clamped onto the top of this step and the side of the step runs on top of a frame edge. The body has a rear edge that is contoured to fit comfortably against the palm of the user's right or left hand, and forward edge portion that has a smooth top face for riding along a side of the frame edge, and a rear side that is contoured at its lateral edges to provide a safe and comfortable rest for the index finger of the user.

Further objects, features and advantages of the present invention will become more apparent from the detailed description of the preferred embodiment set forth below when viewed in conjunction with the figures of the accompanying drawings.

DETAILED DESCRIPTION OF THE PREFERRED EMBODIMENT

Figure 1:
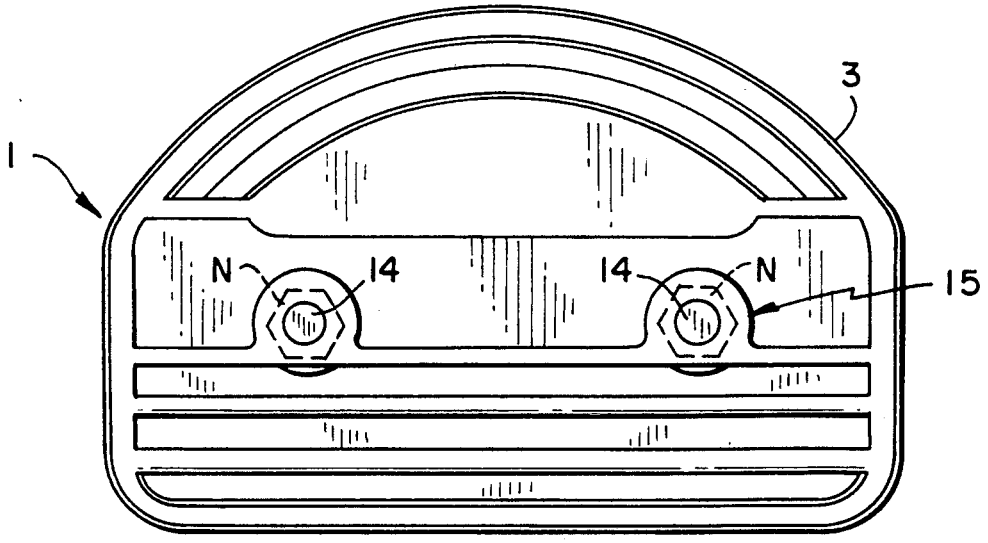
FIG. 1 is a bottom plan view of a body of a trimmer according to a preferred embodiment of the present invention.
Figure 2:
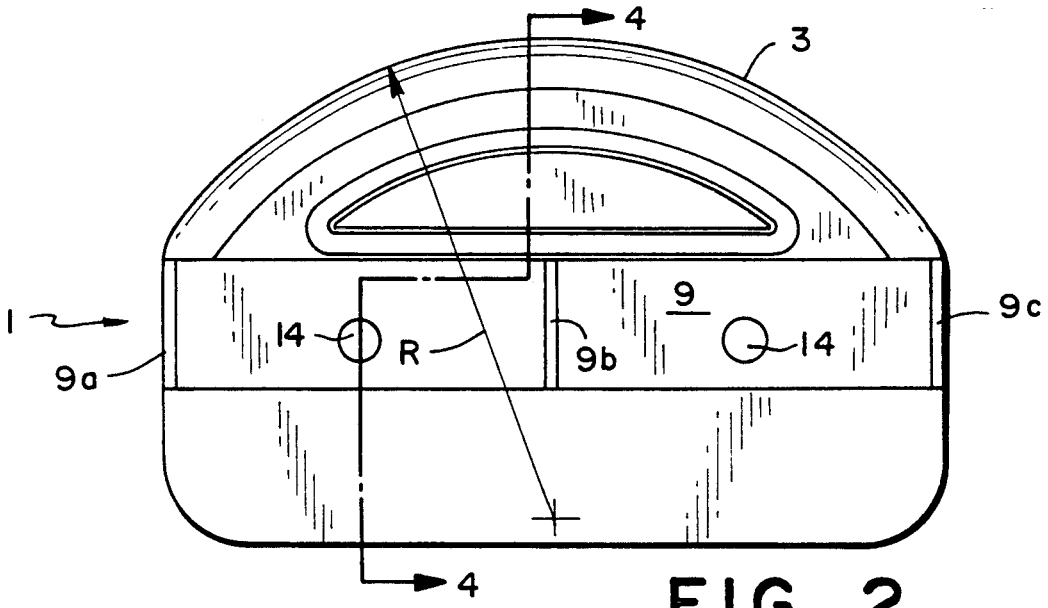
FIG. 2 is a top plan view of the body of the trimmer shown in FIG. 1.
Figure 3:
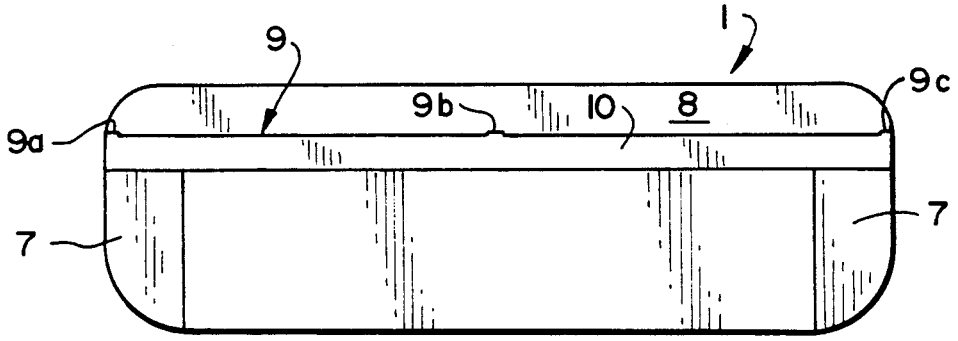
FIG. 3 is front edge elevational view of the body of the trimmer shown in FIGS. 1 & 2.

With reference to FIGS. 1–4, the body 1 of a hand-held trimmer in accordance with a preferred embodiment of the present invention is shown which is designed to be held in the palm of either hand is shown. For this purpose, the body 1 is approximately 3.75" from side to side and approximately 2.5" from front to rear. Furthermore, a rear edge 3 of the body is contoured to fit comfortably against the palm of the user's right or left hand (see FIGS. 8 & 9), and a rear side of a forward edge portion 5 is contoured at its lateral edges 7 to provide a safe and comfortable rest for the index finger of the user. To this end, the rear edge 3 has a mildly rounded shape having a radius of curvature R of about 2.3" for a trimmer having the above length and width dimensions, and the rear side of lateral edges can have an approximately 0.375" radius concave curvature. To provide a more attractive appearance free of sharp corners, the front edge corners can be rounded with a radius $r_1$ of 0.375", and the rear edge 3 can meet the sides of the body 1 with a transition curvature having a radius $r_2$ of 0.4375", for example.

Figure 8:
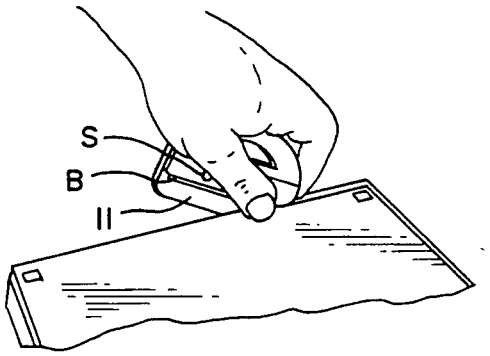
FIGS. 8 & 9 are views illustrating use of the preferred embodiment trimmer in a user's left and right hand, respectively.
Figure 9:
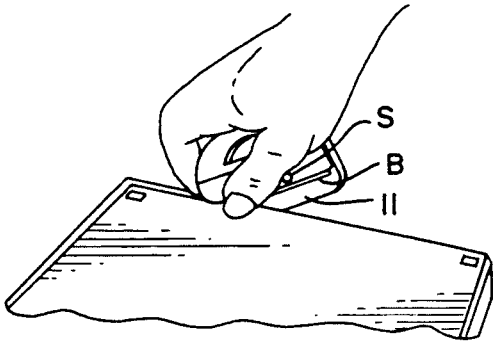

The top of the body 1 is formed with two pairs of perpendicular surfaces. Surfaces 8 and 9 form a mounting surface for a pair of conventional single-edge mat-cutting or other razor blades B (FIGS. 8 & 9). While the surface 9 can be flat with a length that is more than twice the length of a single blade B, preferably, raised bars 9*a*, 9*b*, & 9*c* are formed on it to facilitate positioning of the blades. The width of surface 9 is less than the width of the blade to insure that at least the cutting edge of the blade projects beyond surface 10 to hang over the surface 11. To secure each blade in place, a holding strip 12 is provided for each blade that is of a length that is at least as long as the respective blade. Each holding strip 12 has a through hole 13 for a mounting screw S, and the through hole, preferably, is enlarged at its top end to enable the head of the screw S to be received in it.

Figure 4:
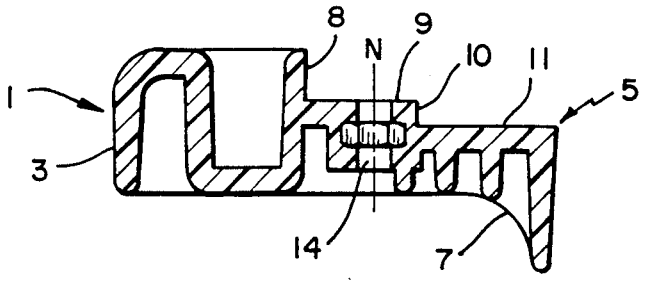
FIG. 4 is a cross-sectional view of the body of the trimmer shown in FIGS. 1–3 taken along line 4—4 in FIG. 2.
Figure 5:
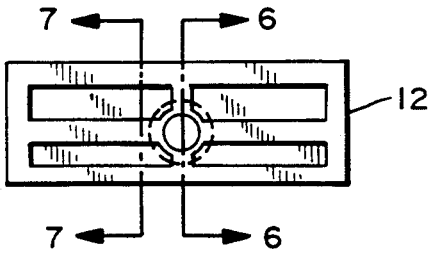
FIG. 5 is a bottom plan view of a clamping element for holding a blade upon the body of the trimmer.
Figure 6:
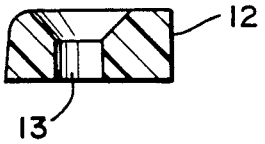
FIGS. 6 & 7 are cross-sectional views taken along lines 6—6 and 7—7 of FIG. 5.
Figure 7:
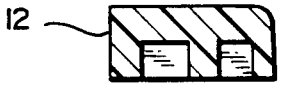

For retaining the threaded end of the screw, the body 1 contains a receiving bore 14 which passes through a nut N (FIGS. 1 & 4). Preferably, the body 1 is made of molded plastic material and the nut N is molded in place within formations 15 during production of the body 1. Alternatively, the formations 15 could be made of solid plastic and their bores subsequently tapped to provide receiving threads for the screw.

To minimize weight and the amount of molding material required, advantageously, as shown, both the body 1 and the strips 12 and formed with recesses 17. However, to insure adequate strength, one or more strengthening ribs 19 can be provided.

The purpose of surfaces 10 and 11 is clear from the illustration of the manner of using the trimming device of the present invention shown in FIGS. 8 & 9. In particular, surface 10 is brought into contact with the back of a frame or other support surface, and the depth of the cut can be controlled by regulating the angle at which it is held relative to the support surface, along with the degree of force applied. The surface 11 is brought into contact with the side of the frame or support surface and serves as a guide for ensuring that a straight cut is made by being held lightly against the side of the frame as one of the blades of the trimmer is run along the dust cover paper P or other material on the back of the frame.

As can be appreciated from the foregoing, the present invention provides a trimmer that works equally well in either the right or the left hand, and can be comfortably gripped for long hours of use without cramping. Furthermore, the trimmer has a simple and solid construction that assures the trimming of consistent evenly spaced borders, yet it can be produced easily and inexpensively.

While only a single preferred embodiment has be shown and described, it should be appreciated that it is subject to numerous modifications and variations without departing from the scope of the invention. Thus, the present invention should be viewed as encompassing the full scope of the appended claims.

I claim:

1. A hand-held razor edge trimmer that can be comfortably held in either hand of a user to safely and easily trim material, including dust cover paper applied over a rear surface of a frame, said trimmer comprising a palm-sized body having a pair of step-like razor blade mounting surfaces and an adjacent pair of step-like guiding surfaces formed thereon; and means for clamping a pair of razor blades onto one of the mounting surfaces so as to cause a cutting edge of the blade to overhang the step-like guiding surfaces; wherein the body of the trimmer has a rear edge that is arcuately contoured to fit comfortably against the palm of either of the user's hands; and wherein a forward edge portion of the body of the trimmer has a rear side that is arcuately contoured at lateral edges thereof to provide a safe and comfortable rest for an index finger of either of the user's hands.

2. A hand-held razor edge trimmer according to claim 1, wherein the body of the trimmer is formed of molded plastic.

3. A hand-held razor edge trimmer according to claim 2, wherein said means for clamping comprises at least one plastic strip and a fastener which passes through a hole in said strip and a bore in said body.

4. A hand-held razor edge trimmer according to claim 3, wherein said fastener is a screw, and a nut for said screw is embedded within the plastic of said body of the trimmer.

5. A hand-held razor edge trimmer according to claim 3, wherein both the body and the at least one strip are formed with recesses for reducing weight and at least one strengthening rib.

6. A hand-held razor edge trimmer according to claim 2, wherein the mounting surface on which the blades are clamped is more than twice the length of a single blade and has a width that is less than the width of the blades.

7. A hand-held razor edge trimmer according to claim 2, wherein the mounting surface on which the blades are clamped has raised bars formed on it to facilitate positioning of the blades.

* * * * *